US007695089B2

(12) United States Patent
Espasa et al.

(10) Patent No.: US 7,695,089 B2
(45) Date of Patent: Apr. 13, 2010

(54) INK SHORT DETECTION

(75) Inventors: Cesar Fernandez Espasa, San Diego, CA (US); Virginia Palacios Camarero, Barcelona (ES); Santiago Garcia-Reyero Vinas, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1042 days.

(21) Appl. No.: 11/213,067

(22) Filed: Aug. 25, 2005

(65) Prior Publication Data

US 2007/0046712 A1 Mar. 1, 2007

(51) Int. Cl.
*B41J 29/393* (2006.01)

(52) U.S. Cl. ..... 347/19

(58) Field of Classification Search ..... 347/19, 347/22, 33, 34, 16, 15, 41, 17, 77
See application file for complete search history.

(56) References Cited

U.S. PATENT DOCUMENTS

| | | | | |
|---|---|---|---|---|
| 4,119,973 | A * | 10/1978 | Stager | 347/77 |
| 4,196,625 | A | 4/1980 | Kern | |
| 4,616,234 | A | 10/1986 | Wint | |
| 5,162,817 | A | 11/1992 | Tajika et al. | |
| 5,623,290 | A | 4/1997 | Iida et al. | |
| 5,988,783 | A | 11/1999 | Tajika et al. | |
| 6,378,979 | B1 * | 4/2002 | Anderson | 347/19 |
| 6,578,940 | B2 | 6/2003 | Rehmann et al. | |
| 6,631,962 | B2 | 10/2003 | Rehmann et al. | |
| 6,652,056 | B2 * | 11/2003 | Shioya | 347/12 |
| 7,287,822 | B2 * | 10/2007 | Espasa et al. | 347/15 |
| 7,300,128 | B2 * | 11/2007 | Espasa et al. | 347/15 |
| 7,303,249 | B2 * | 12/2007 | Nicodem | 347/19 |
| 7,396,511 | B2 * | 7/2008 | Fujii et al. | 422/100 |
| 2003/0025740 | A1 | 2/2003 | Rehmann et al. | |
| 2003/0222934 | A1 | 12/2003 | Choi et al. | |
| 2004/0017443 | A1 | 1/2004 | Ikeda et al. | |
| 2004/0021712 | A1 | 2/2004 | Yamamoto et al. | |
| 2004/0046812 | A1 | 3/2004 | Lapstun et al. | |
| 2004/0183848 | A1 | 9/2004 | Hasseler | |
| 2006/0203027 | A1 * | 9/2006 | Espasa et al. | 347/17 |

FOREIGN PATENT DOCUMENTS

| | | | |
|---|---|---|---|
| JP | 59-221168 | | 12/1984 |
| JP | 62160242 | A | 7/1987 |
| JP | 62-214964 | | 9/1987 |
| JP | 07-154555 | | 6/1995 |
| JP | 07154555 | A * | 6/1995 |
| JP | 2003-341088 | | 3/2003 |

OTHER PUBLICATIONS

Transmittal of the International Search Report and the Written Opinion of the International Searching Authority dated Dec. 28, 2006.

* cited by examiner

*Primary Examiner*—Stephen D Meier
*Assistant Examiner*—Rene Garcia, Jr.

(57) ABSTRACT

The present invention provides a method to detect ink short in a print head and an apparatus that performs the method. The method provides the steps of obtaining a density profile and a current consumption profile of an image to be printed and using the profiles to detect a low-resistance ink short or a non-low resistance ink short in a print head.

12 Claims, 5 Drawing Sheets

INK SHORT DETECTION

BACKGROUND

Inkjet printers face potential safety and other issues due to ink shorts. Some types of ink shorts may result in damage to a print head or cause overheating that can impact print quality

BRIEF DESCRIPTION OF THE DRAWINGS

Detailed description of embodiments of the present disclosure will be made with reference to the accompanying drawings.

DETAILED DESCRIPTION

Figure 1:
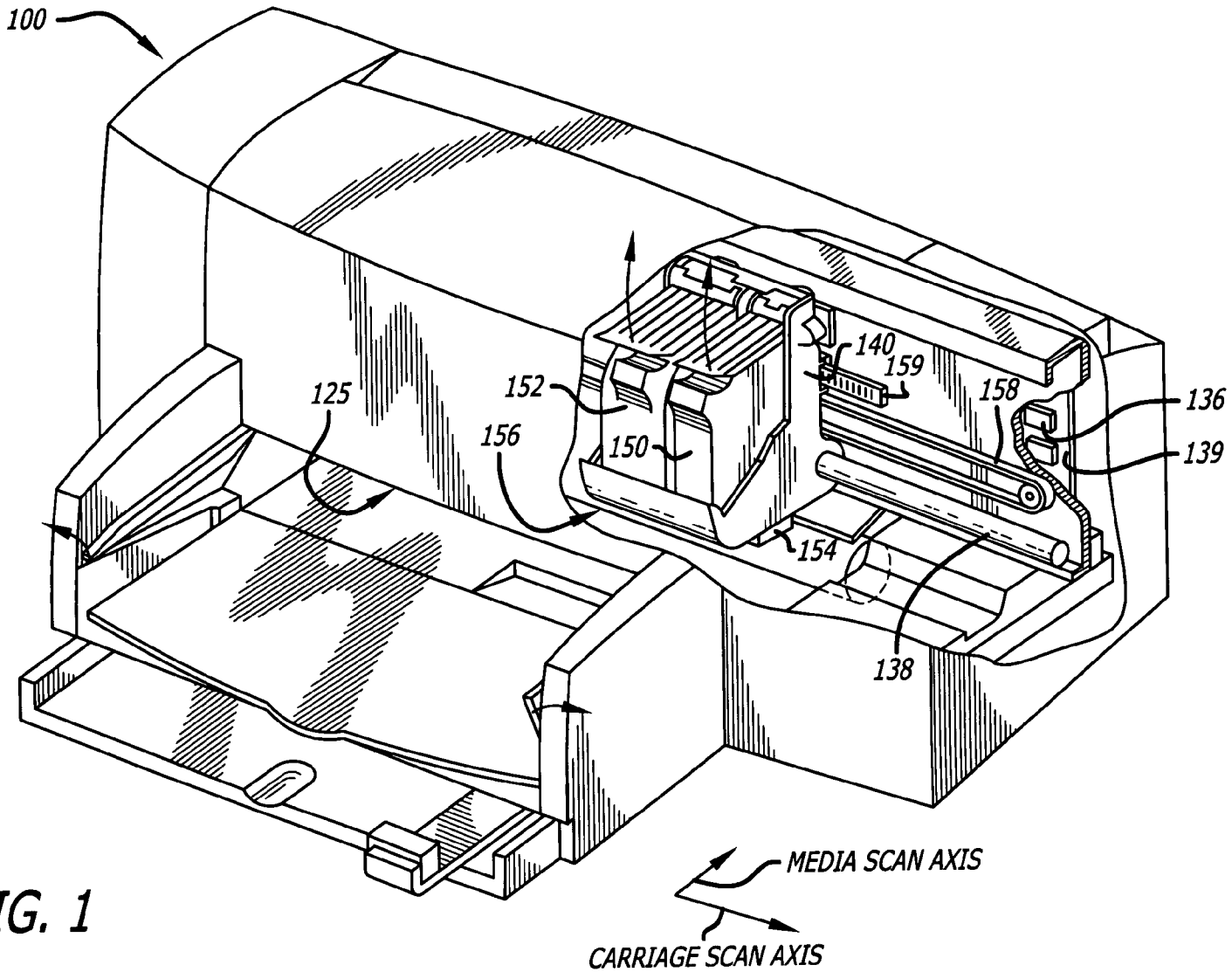
FIG. 1 is a perspective view of an embodiment of an image forming system.

The following is a detailed description for carrying out embodiments of the present disclosure. This description is not to be taken in a limiting sense, but is made merely for the purpose of illustrating the general principles of the example embodiments of the present disclosure.

Various embodiments involve analyzing the image from a density perspective before printing it. In an example embodiment, the outcome of this analysis is a density profile, an estimate based on the content of the image to be printed (not on the current consumption of previously printed images).

As noted above, some types of ink shorts may result in damage to a print head or cause overheating that can impact print quality. For example, in some applications, aerosol sprayed around the print head(s) is deposited over its electrical contacts. Ink dendrites are formed around the nozzles, and can eventually short two signals and damage the print head or the printer electronics. However, a semi-permanent or a non low-resistance short presents different challenges, mainly, a temperature rise due to the extra current flow.

Embodiments described herein allow for early detection of low resistance ink shorts and provides the ability to detect non-low resistance ink shorts while printing. In an example embodiment, this is achieved using a current model of the print head and an image density analysis before printing the image to predict the current consumption profile.

An example embodiment allows for programming a current threshold closer to the real limit and not to a limit determined using the highest expected current draw for the print head in its application, sometimes referred to as a worst case limit. With this technique, dead ink shorts can be detected sooner thus lessening the likelihood of damaging the print head.

In another embodiment, by recording the current drawn by each image and comparing this to the prediction it is possible to detect semi-permanent and non-low resistance ink shorts while printing. If the real profile is greater than the predicted profile, but not high enough to reach the programmed threshold, then a non-low resistance or semi-permanent ink short is probably the cause. This comparison can be performed in real time without having the printer stop the printing, or after the image has been printed.

In an example embodiment, a method includes obtaining a density profile of an image (e.g., before printing the image), and using the density profile to detect an ink short (e.g., a low resistance ink short, or a non-low resistance ink short) in a print head (e.g., while printing the image). In an example embodiment, the method includes using a current model of the print head and the density profile to estimate a greatest current expected from printing the image, using the greatest current expected to determine a current consumption threshold, and indicating a print head error condition if an actual print head current measured during printing the image exceeds the current consumption threshold. In an example embodiment, the method includes removing power from the print head if the print head error condition exists. In an example embodiment, the method includes using a current model of the print head and the density profile to estimate a current consumption profile that would result from printing the image, and indicating a printing anomaly if an actual print head current measured during printing the image is not sufficiently close to the current consumption profile. In an example embodiment, the method includes servicing the print head if the printing anomaly exists. In an example embodiment, the current model includes an electrical resistance and/or a temperature of a component of the print head. In an example embodiment, the method includes processing image data and a current model of the print head to estimate a greatest current to be used by the print head to print an image using the image data, and comparing an actual print head current measured during printing the image with the greatest current to determine if a print head error condition exists. In an example embodiment, the method includes using the greatest current to determine a current consumption threshold, and removing power from the print head if the actual print head current exceeds the current consumption threshold.

FIG. 1 illustrates an example embodiment of an image forming system 100 (e.g., an inkjet printing device) in which the principles described herein can be employed. In this example embodiment, the image forming system 100 includes a controller 136, schematically illustrated as a microprocessor, disposed on a printed circuit board 139. The controller 136 receives instructions from a host device such as a personal computer (not shown) and controls the operation of the image forming system 100 including advance of print media through the print zone 125, movement of a print carriage 140, and application of signals to generate ink drops. In an example embodiment, the printed circuit board 139 includes or has access to a memory or other storage device.

In this example embodiment, the print carriage 140 supports first and second removable inkjet print head cartridges 150, 152 (each of which is sometimes called a "pen," "print cartridge," or "cartridge"). The print cartridges 150, 152 include respective print heads 154, 156 that respectively have generally downwardly facing nozzles for ejecting ink generally downwardly onto a portion of the print media that is in the print zone 125. By way of example, the print cartridge 150 is a monochrome printing cartridge while the print cartridge 152 is a tri-color printing cartridge.

In this example embodiment, the print carriage 140 is driven along the slider rod 138 by an endless belt 158 which can be driven by a drive gear, and a linear encoder strip 159 is utilized to detect position of the print carriage 140 along the carriage scan axis.

An example application for the principles disclosed herein is that of inkjet printing. Inkjet printers operate by expelling a small volume of ink through a plurality of small nozzles or orifices in a surface held in proximity to a medium upon which marks or printing is to be placed. These nozzles are arranged in a fashion in the surface such that the expulsion of a droplet of ink from a determined number of nozzles relative to a particular position of the medium results in the production of a portion of a desired character or image. Controlled repositioning of the substrate or the medium and another expulsion of ink droplets continues the production of more pixels of the desired character or image. Inks of selected colors may be coupled to individual arrangements of nozzles so that selected firing of the orifices can produce a multicolored image by the inkjet printer.

Expulsion of the ink droplet in a thermal inkjet printer is a result of rapid thermal heating of the ink to a temperature which exceeds the boiling point of the ink solvent and creates a vapor phase bubble of ink. Rapid heating of the ink can be achieved by passing a pulse of electric current through a resistor, typically for 0.5 to 5 microseconds. Each nozzle may be coupled to a small ink firing chamber filled with ink and having the individually addressable heating element resistor thermally coupled to the ink. As the bubble nucleates and expands, it displaces a volume of ink which is forced out of the nozzle and deposited on the medium. The bubble then collapses and the displaced volume of ink is replenished from a larger ink reservoir by way of ink feed channels. After the deactivation of the heater resistor and the expulsion of ink from the firing chamber, ink flows back into the firing chamber to fill the volume vacated by the ink which was expelled.

Figure 1A:
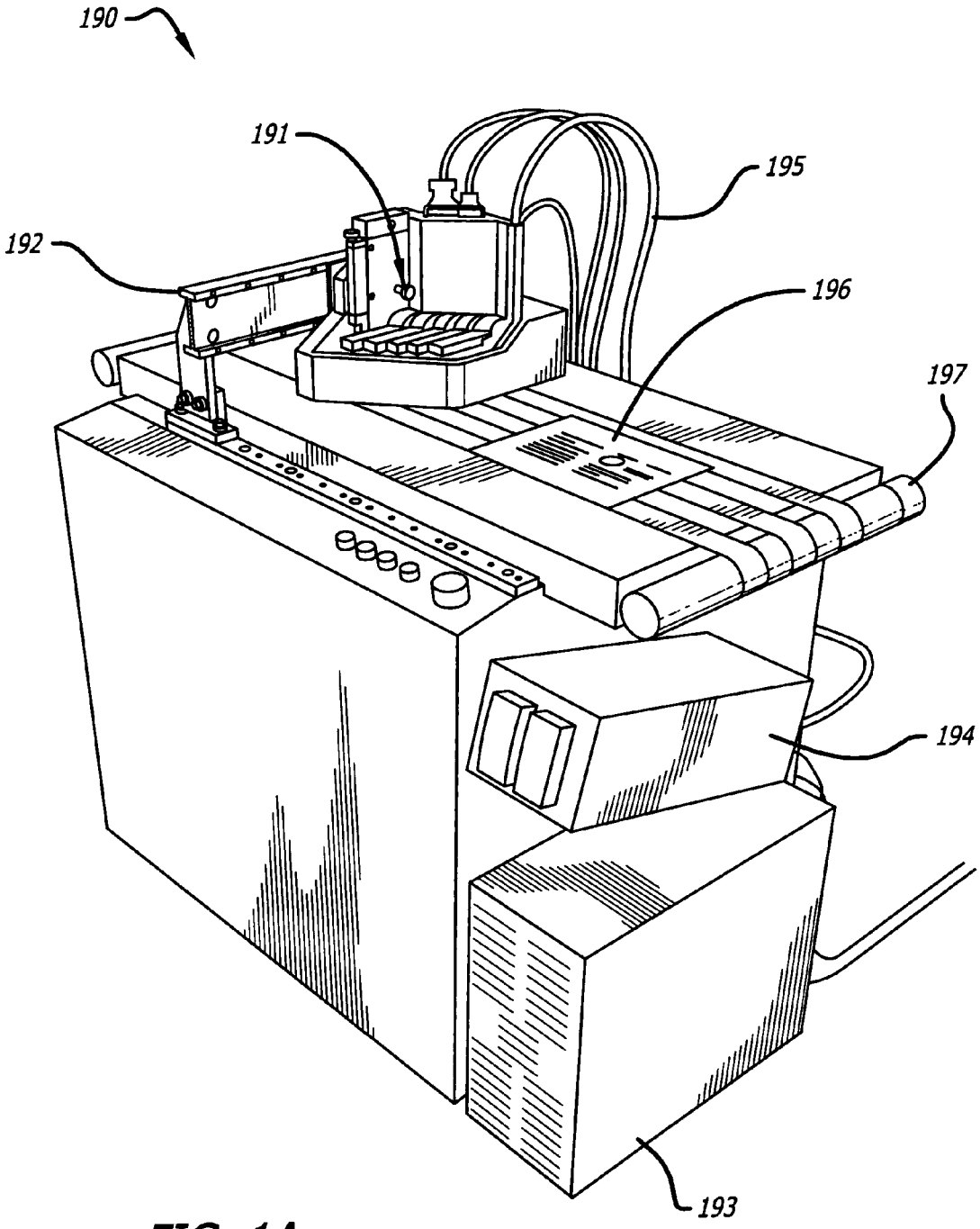
FIG. 1A is a perspective view another embodiment of an image forming system.

The principles described herein are applicable to a wide variety of image forming devices including but not limited to inkjet products, industrial printers, and large-format printers. Referring to FIG. 1A, in another example embodiment, an image forming system 190 includes a modular print head assembly 191 operatively connected with and secured to a support structure 192. In this example embodiment, the printing functions of the modular print head assembly 191 are controlled by printing electronics (e.g., positioned within electronics housing 193), and an ink delivery system 194 is operatively connected with the modular print head assembly 191 by ink line and cables (collectively denoted 195). In this example embodiment, media 196 is repositioned in relation to the modular print head assembly 191 during a printing operation, and an encoder 197 assists in monitoring such positional changes.

Figure 2:
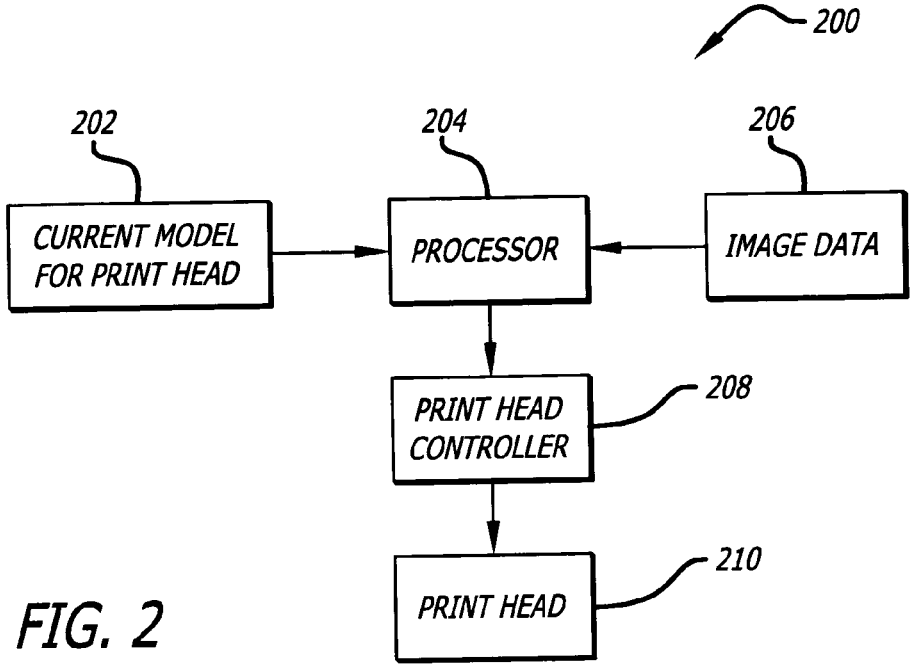
FIG. 2 is a diagram illustrating an embodiment of an image processing and print head control apparatus.

FIG. 2 is a diagram illustrating an embodiment of an image processing and print head control apparatus 200. In this example embodiment, a processor 204 receives and processes a print head current model 202 and image data 206. The processor 204 is suitable for use with various image producing devices and can be included as part of on-board electronics which are part of such devices, or remotely located in relation to such devices. In an example embodiment, a printing apparatus includes an image producing device including a print head and configured to print an image, and a processor (such as processor 204) programmed to analyze image content of the image and a current model of the print head to (e.g., before the image is printed), estimate a current consumption profile that would result from printing the image and to compare a print head current measurement taken during printing the image with the current consumption profile to determine if an overcurrent condition occurred. In an example embodiment, the image content includes a density of the image.

Figure 3:
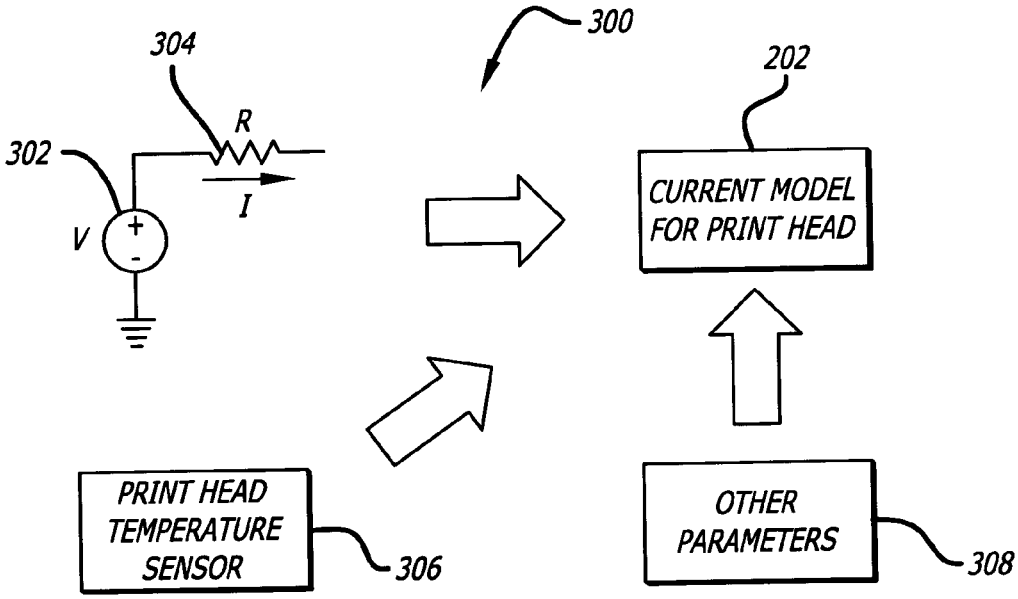
FIG. 3 is a diagram illustrating an embodiment of a technique 300 for establishing the current model of FIG. 2.

FIG. 3 is a diagram illustrating an embodiment of a technique 300 for establishing the current model 202. In this example embodiment, the current model 202 includes an electrical resistance of a component of the print head. In an example embodiment, the component is a nozzle resistor. The current model 202 may also include a temperature of a component of the print head. For example, the average temperature of the print head is provided by a print head temperature sensor 306 (e.g., a thermal sensor resistor (TSR) on the die). By way of example, the current model 202 (e.g., for a particular print head) is determined by finding a model for the current drawn by a single nozzle resistor and then multiplying that current by the number of nozzles firing at that column. In this example, the current I consumed by the resistor 304 is the voltage V (provided by the pen power supply 302) divided by resistance R, where R can be temperature dependent. After calibration, in an example embodiment, the voltage V output by the pen power supply 302 is substantially constant for a particular pen. The resistance R may depend on the print head temperature and other parameters. Therefore, as conceptually illustrated in this example, an output of the print head temperature sensor 306 and/or other parameters 308 can also be used to establish the current model 202.

Figure 4A:
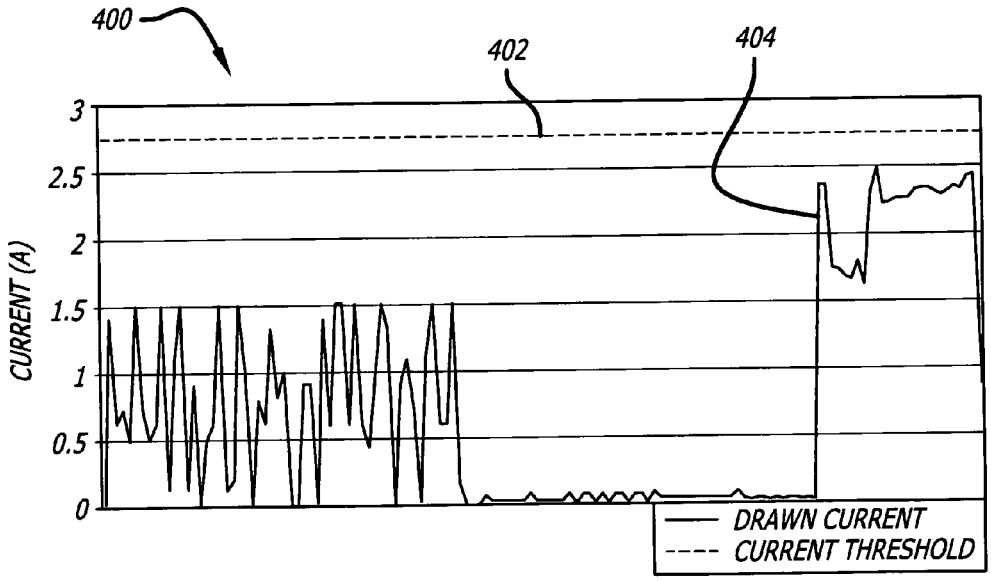
FIG. 4A is a plot showing an example worse case limit and a current threshold for detecting dead ink shorts according to one embodiment.
Figure 4B:
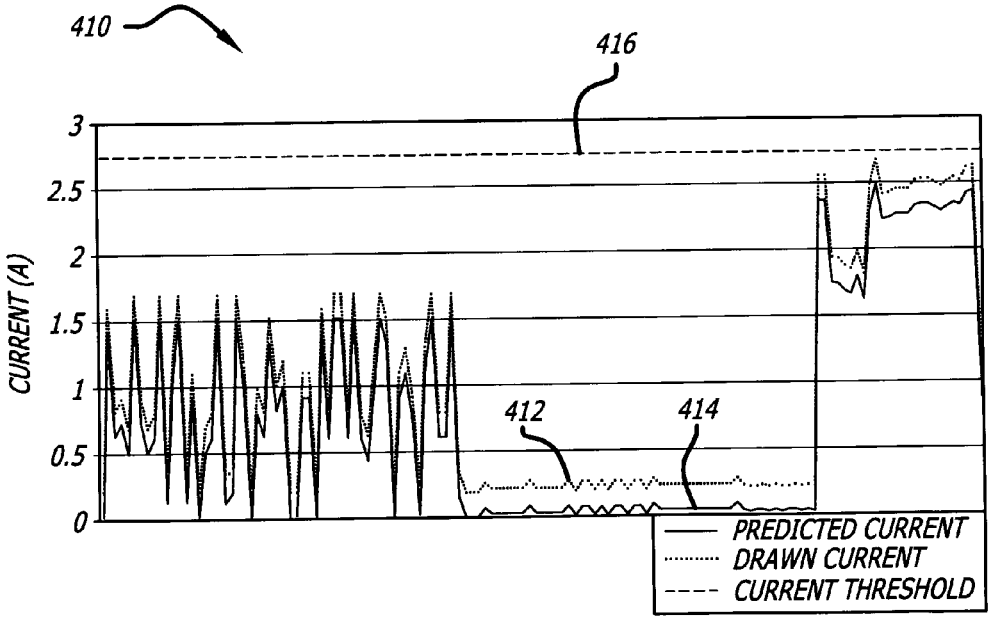
FIG. 4B is a plot showing an example real profile that is greater than a predicted profile, but not high enough to reach a programmed threshold, for detecting a non-low resistance or semi-permanent ink short according to one embodiment.

With respect to current consumption profiles, FIG. 4A is a plot 400 showing an example worse case limit threshold 402 (e.g., determined without using the disclosed prediction) and the actual current consumption 404. FIG. 4B is a plot 410 showing an example real profile 412 that is greater than a predicted profile 414, but not high enough to reach a programmed threshold 416, for detecting a non-low resistance or semi-permanent ink short. It should be appreciated that current consumption profiles vary depending upon the nature of the image data.

The energy used to print an image depends largely on the image density and so does the current consumption. A full blackout image can consume much more current than a semi-permanent ink short. Even a small dark area can produce a short peak in current consumption higher than a semi-permanent ink short.

In various embodiments, an algorithm is used to predict the maximum print head current while printing an image based on the image content, and a current limit that is lower than the current drawn by a blackout image is programmed. This lower current limit results in earlier detection of a low resistance short than if the blackout image current level were used. By closed loop monitoring the real (actual) current consumption, incipient ink shorts can be detected by comparing the recorded and the predicted values without stopping printing.

Using a current model of the print head, an estimation of the current drawn while printing the image can be calculated and therefore the greatest expected current for that specific image is determined. With that value having been determined, an appropriate current threshold can be calculated and programmed for that particular image. If the image is not a blackout, that limit will be lower and thus the system will detect a low resistance ink short faster, especially for lighter images. The current information can be used at desired points in time to reprogram the threshold as the image is being printed (e.g., in real time synchronized with the printing).

If the current drawn by each image is recorded and compared to the prediction, semi-permanent and non-low resistance ink shorts can be detected while printing. More specifically, if it has been determined (from the prediction) how much current is to be used at every point of the image, any deviation from the prediction (e.g., an increment in ink consumption) is a potential failure. The comparison can be performed in real time or after the image has been printed; however, the printer does not have to stop in order to perform this comparison. For repetitive jobs (e.g., copies) the density profile analysis can be skipped after the first copy.

In an example embodiment, a printing apparatus includes a mechanism for estimating a current consumption profile that would result from printing an image, and an image producing device configured to print the image and to compare a print head current measured while printing the image to the current consumption profile to determine whether an overcurrent condition exists. In an example embodiment, the mechanism for estimating includes a mechanism for performing an image density analysis on the image. In an example embodiment, the mechanism for estimating includes a mechanism for modeling current use by the print head. In an example embodiment, the overcurrent condition indicates a print head error condition (e.g., caused by a dead ink short). In an example embodiment, the overcurrent condition indicates a printing anomaly (e.g., caused by a non-low resistance ink short).

In an example embodiment, a printing system includes a print head, a controller for providing signals to the print head to print an image, and an overcurrent detection device configured to analyze image content of the image to estimate a current consumption profile that would result from printing the image and to compare a print head current measured while printing the image with the current consumption profile to determine if an overcurrent condition occurred. In an example embodiment, the overcurrent detection device is configured to also use a current model of the print head to estimate the current consumption profile. In an example embodiment, the current model includes an electrical resistance and/or a temperature of a component of the print head. In an example embodiment, the overcurrent condition indicates a print head error condition (e.g., caused by a low resistance ink short). In an example embodiment, the overcurrent condition indicates a printing anomaly (e.g., caused by a non-low resistance ink short).

In an example embodiment, an image processing apparatus includes a storage device upon which is stored a computer-executable program which when executed by a processor enables the processor to analyze image content of an image to estimate a current consumption profile that would result from printing the image and to compare a print head current measurement taken during printing the image with the current consumption profile to determine if an overcurrent condition occurred. In an example embodiment, the computer-executable program also uses a current model of the print head to estimate the current consumption profile. In an example embodiment, the current model includes an electrical resistance and/or a temperature of a component of the print head. In an example embodiment, the overcurrent condition indicates a print head error condition (e.g., caused by a low resistance ink short). In an example embodiment, the overcurrent condition indicates a printing anomaly (e.g., caused by a non-low resistance ink short).

Figure 5:
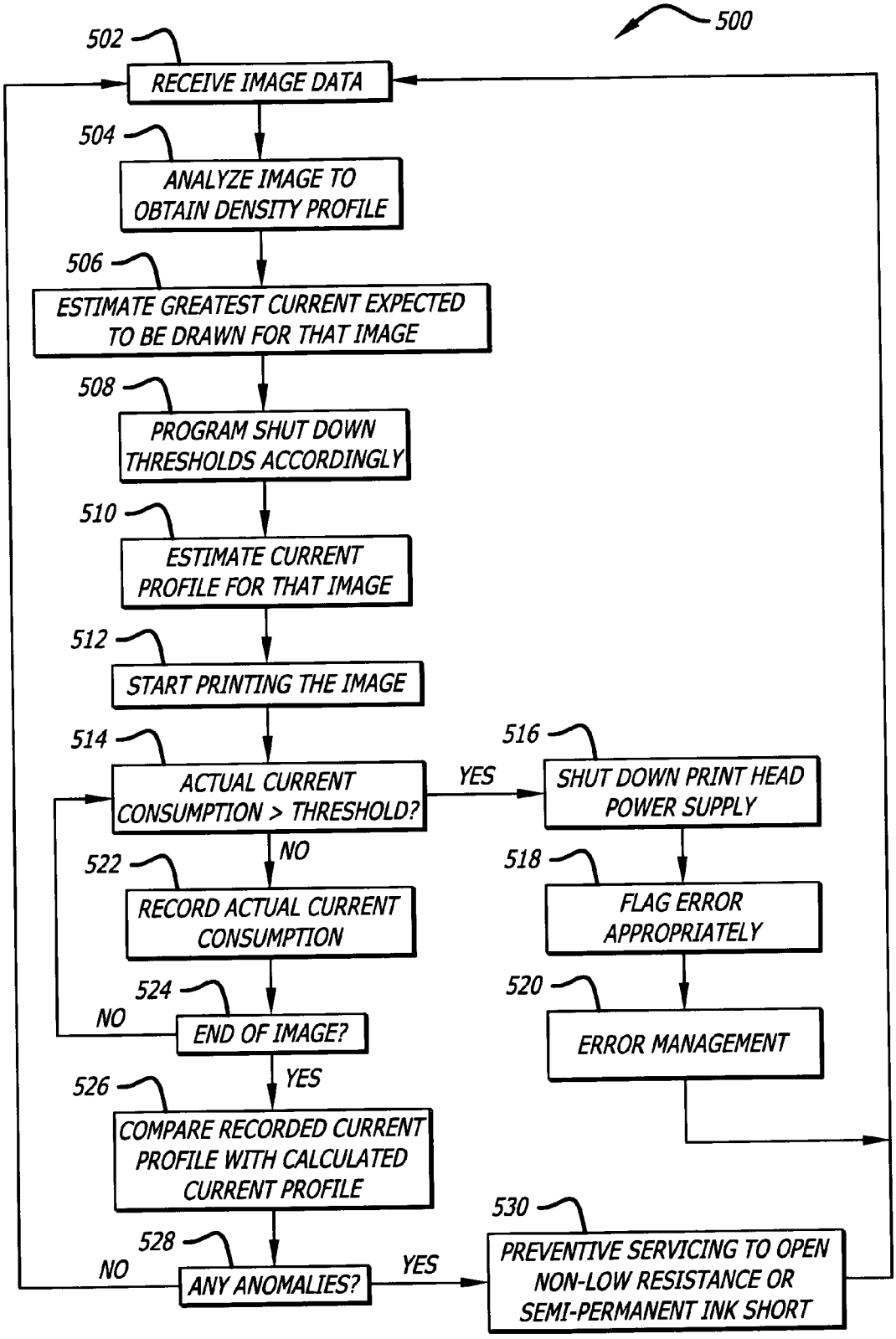
FIG. 5 is a flowchart illustrating an embodiment of an image processing method.

FIG. 5 illustrates an example embodiment of an image processing method 500. At 502 image data is received, and analyzed at 504 to obtain a density profile. At 506, the greatest current expected to be drawn by the print head for forming that image is estimated (e.g., using the current model). At 508, shut down thresholds against low resistance ink shorts are programmed according to the estimate. At 510, the current profile for that image is estimated. At 512, printing of the image is started. If it is determined at 514 that the actual current consumption is greater than a print head shut down threshold, then at 516 the print head power supply is shut down. Under such a condition, at 518 the error is flagged and at 520 an error management routine is executed before returning to 502.

If it is determined at 514 that the actual current consumption is not greater than the print head shut down threshold, then at 522 the actual current consumption is recorded. If it is next determined at 524 that the end of the image has not yet been reached (i.e., a portion of the image still has yet to be printed), the process loops back to 514 where the comparison is again performed. If at 524 it is determined that the end of the image has been reached, then at 526 the recorded current profile is compared with the calculated current profile. If at 528 any anomalies are detected, at 530 preventive servicing is performed to open the non-low resistance or semi-permanent ink short detected before returning to 502. If no anomalies are detected at 528, the process then returns to 502 to receive data for the next image.

In an example embodiment, an image processing method includes processing image data and a current model of a print head to estimate a greatest current expected to be drawn by the print head to print an image using the image data, and comparing an actual print head current measured during printing the image with the greatest current expected to by drawn by the print head to determine if a print head error condition exists. In an example embodiment, the current model includes an electrical resistance and/or a temperature of a component of the print head. In an example embodiment, the image processing method further includes removing power from the print head if the print head error condition exists. In an example embodiment, the image processing method further includes removing power from the print head if the print head error condition indicates a low resistance ink short. In an example embodiment, the image processing method further includes using the greatest current expected to determine a current consumption threshold, and removing power from the print head if the actual print head current exceeds the current consumption threshold.

In an example embodiment, an image processing method includes processing image data and a current model of a print head to estimate a current consumption profile that would result from printing an image using the image data, and comparing an actual print head current measured during printing the image with the current consumption profile to determine if a printing anomaly occurred. In an example embodiment, the current model includes an electrical resistance and/or a temperature of a component of the print head. In an example embodiment, the image processing method further includes servicing the print head if the printing anomaly exists. In an example embodiment, the image processing method further includes servicing the print head if the printing anomaly indicates a non-low resistance or semi-permanent ink short.

Although embodiments of the present disclosure have been described in terms of the example embodiments above, numerous modifications and/or additions to the above-described embodiments would be readily apparent to one skilled in the art. It is intended that the scope of the claimed subject matter extends to all such modifications and/or additions.

What is claimed is:

1. A method comprising:

analyzing an image to obtain a density profile of the image, the image to be printed using an inkjet-printing device, the image not being a completely blacked out image;

after analyzing the image to obtain the density profile of the image, estimating a greatest amount of current expected to be drawn by an inkjet printhead of the inkjet-printing device while printing the image, the greatest amount of current estimated based on the density profile of the image and based on a current model of the inkjet printhead, the greatest amount of current expected to be drawn by the inkjet printhead while printing the image being lower than a greatest amount of current expected to be drawn by the inkjet printhead while printing a completely blacked out image;

after estimating the greatest amount of current expected to be drawn by the inkjet printhead while printing the image, and while printing the image by the inkjet printhead of the inkjet-printing device, determining whether an actual current consumed by the inkjet printhead while printing the image exceeds the greatest amount of current expected to be drawn by the inkjet printhead while printing the image; and, in response to determining that the actual current consumed exceeds the greatest amount of current expected to be drawn, signaling an ink short error condition to a user of the inkjet-printing device and stopping printing of the image.

2. The method of claim 1, wherein the greatest amount of current expected to be drawn by the inkjet printhead while printing the image being lower than the greatest amount of current expected to be drawn by the inkjet printhead while printing the completely blacked out image results in the ink short error condition being signaled to the user sooner.

3. The method of claim 1, further comprising:

before printing the image by the inkjet printhead of the inkjet-printing device, estimating a current profile for the image based on the density profile of the image;

while printing the image by the inkjet printhead of the inkjet-printing device, recording the actual current consumed by the inkjet printhead to construct an actual current profile for the image based on printing of the image by the inkjet printhead;

after the image has been printed by the inkjet printhead of the inkjet-printing device without the actual current consumed by the inkjet printhead while printing the image ever being greater than the greatest amount of current expected to be drawn by the inkjet printhead while printing the image, comparing the current profile for the image that was estimated for the image based on the density profile of the image to the actual current profile for the image that was constructed based on printing of the image by the inkjet printhead;

where an anomaly between the current profile that was estimated and the actual current profile are detected as a result of the comparison, performing preventative servicing of the inkjet-printing device.

4. The method of claim 3, wherein the anomaly is caused by a non-low resistance ink short.

5. The method of claim 1, wherein the current model comprises an electrical resistance of a component of the inkjet printhead.

6. The method of claim 5, wherein the current model further comprises a temperature of the component of the inkjet printhead.

7. An inkjet printing device comprising:

an inkjet printhead;

a controller to:

analyze an image to obtain a density profile of the image, the image to be printed by the inkjet-printing device, the image not being a completely blacked out image;

after analyzing the image to obtain the density profile of the image, estimate a greatest amount of current expected to be drawn by the inkjet printhead while printing the image, the greatest amount of current estimated based on the density profile of the image and based on a current model of the inkjet printhead, the greatest amount of current expected to be drawn by the inkjet printhead while printing the image being lower than a greatest amount of current expected to be drawn by the inkjet printhead while printing a completely blacked out image;

after estimating the greatest amount of current expected to be drawn by the inkjet printhead while printing the image, and while printing the image by the inkjet printhead of the inkjet-printing device, determine whether an actual current consumed by the inkjet printhead while printing the image exceeds the greatest amount of current expected to be drawn by the inkjet printhead while printing the image; and, in response to determining that the actual current consumed exceeds the greatest amount of current expected to be drawn, signal an ink short error condition to a user of the inkjet-printing device and stop printing of the image.

8. The inkjet printing device of claim 7, wherein the greatest amount of current expected to be drawn by the inkjet printhead while printing the image being lower than the greatest amount of current expected to be drawn by the inkjet printhead while printing the completely blacked out image results in the ink short error condition being signaled to the user sooner.

9. The inkjet printing device of claim 7, wherein the controller is further to:

before printing the image by the inkjet printhead, estimate a current profile for the image based on the density profile of the image;

while printing the image by the inkjet printhead, record the actual current consumed by the inkjet printhead to construct an actual current profile for the image based on printing of the image by the inkjet printhead;

after the image has been printed by the inkjet printhead without the actual current consumed by the inkjet printhead while printing the image ever being greater than the greatest amount of current expected to be drawn by the inkjet printhead while printing the image, compare the current profile for the image that was estimated for the image based on the density profile of the image to the actual current profile for the image that was constructed based on printing of the image by the inkjet printhead;

where an anomaly between the current profile that was estimated and the actual current profile are detected as a result of the comparison, perform preventative servicing of the inkjet-printing device.

10. The inkjet printing device of claim 9, wherein the anomaly is caused by a non-low resistance ink short.

11. The inkjet printing device of claim 7, wherein the current model comprises an electrical resistance of a component of the inkjet printhead.

12. The inkjet printing device of claim 11, wherein the current model further comprises a temperature of the component of the inkjet printhead.

* * * * *